US007598217B2

(12) United States Patent
Burg et al.

(10) Patent No.: US 7,598,217 B2
(45) Date of Patent: Oct. 6, 2009

(54) MULTILAYERED DETERGENT SHAPED BODIES WITH VISCOELASTIC PHASE

(75) Inventors: Birgit Burg, Alpen (DE); Dieter Legel, Solingen (DE); Gerhard Blasey, Duesseldorf (DE); Berthold Schreck, Duesseldorf (DE); Peter Schmiedel, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 120 days.

(21) Appl. No.: 10/694,549

(22) Filed: Oct. 27, 2003

(65) Prior Publication Data

US 2004/0127373 A1 Jul. 1, 2004

Related U.S. Application Data

(63) Continuation of application No. PCT/EP02/04170, filed on Apr. 16, 2002.

(30) Foreign Application Priority Data

Apr. 25, 2001 (DE) ..... 101 20 441

(51) Int. Cl.
*C11D 17/00* (2006.01)

(52) U.S. Cl. ..... 510/440; 510/446; 510/447; 510/450

(58) Field of Classification Search ..... 510/446, 510/450, 224, 294, 298
See application file for complete search history.

(56) References Cited

U.S. PATENT DOCUMENTS

| | | | | |
|---|---|---|---|---|
| 6,548,473 | B1 * | 4/2003 | Thoen et al. | 510/446 |
| 6,750,193 | B1 * | 6/2004 | Holderbaum et al. | 510/446 |

FOREIGN PATENT DOCUMENTS

| | | | |
|---|---|---|---|
| WO | WO 94/05758 | A1 | 3/1994 |
| WO | WO 99/20027 | A1 | 7/1995 |
| WO | WO 99/06522 | A1 | 2/1999 |
| WO | WO 99/24547 | A1 | 5/1999 |
| WO | WO 99/24549 | A1 | 5/1999 |
| WO | WO 99/24550 | A1 | 5/1999 |
| WO | WO 99/27063 | A1 | 6/1999 |
| WO | WO 99/27064 | A1 | 6/1999 |
| WO | WO 99/27067 | A1 | 6/1999 |
| WO | WO 02/06438 | A1 | 1/2002 |

* cited by examiner

*Primary Examiner*—Necholus Ogden, Jr.
(74) *Attorney, Agent, or Firm*—David LeCroy

(57) ABSTRACT

A detergent or cleaner shaped body having a viscoelastic phase. The viscoelastic phase contains, based on its weight, 40 to 85% by weight of one or more alkylbenzenesulfonates and has a storage modulus of between 40,000 and 800,000 Pa.

25 Claims, No Drawings

MULTILAYERED DETERGENT SHAPED BODIES WITH VISCOELASTIC PHASE

CROSS-REFERENCE TO RELATED APPLICATIONS

This application is continuation application filed under 35 U.S.C. §365(c) of International Application No. PCT/EP02/04170, filed Apr. 16, 2002 in the European Patent Office, and claiming priority of DE 101 20 441.8, filed Apr. 25, 2001 in the German Patent Office.

BACKGROUND OF THE INVENTION

The present invention relates to detergent and cleaner shaped bodies which have at least one viscoelastic phase.

Detergent or cleaner shaped bodies are described widely in the prior art and have caught on because of their advantages both commercially and with the consumer.

The customary manufacture of detergent or cleaner shaped bodies involves the preparation of particulate premixes which are compressed to tablets by tableting processes known to the person skilled in the art. In the manufacture of detergents or cleaners, the starting substances can often not be tableted directly, but must be converted into a tabletable form by upstream processing steps, for example granulation, which signifies additional time and cost expenditure. In particular, the incorporation of surfactants is problematical in this respect, an additional problem with anionic surfactants being that the acid form of the anionic surfactants which is produced during the manufacture of the surfactants has to firstly be converted into the active substance (the salt) by further neutralization steps.

In addition, the supply form of the compressed tablet means that the ingredients are in direct physical proximity, which, in the case of substances which are incompatible with one another, leads to undesired reactions, instabilities, inactivities or loss of active substance.

To solve the abovementioned problems, it has been proposed in the prior art to provide multiphase tablets in which two or more layers are pressed onto one another. However, this has the disadvantage that the lower layers are subjected to repeated compressive loading, which leads to impaired solubility. Furthermore, said problems were not completely solved by this since tablets with more than three layers cannot be manufactured with reasonable technical expenditure.

A further approach to finding a solution is given in international patent applications WO99/06522, WO99/27063 and WO99/27067. It is proposed here to provide tablets of compressed and noncompressed portions and to incorporate pressure-sensitive substances into the noncompressed portions. According to the teaching of international patent application WO99/27064, a suitable noncompressed phase here is also a "gelatinous" phase, which is obtained from liquids by the addition of thickeners. This has the disadvantage that substances which develop no effect in the washing or cleaning process (thickeners) have to be used, which leads to further costs without additional benefits.

There was thus, as before, the need to provide improved detergent or cleaner shaped bodies which combine the highest degree of mechanical stability with good solubility and permit the incorporation of ingredients which are incompatible with one another. In this connection, the aim was to provide products which combine the convenience and performance (good detergency through a high surfactant content) of a gel-like detergent with the consumer friendliness of the "tablet" supply form. Additionally, the supply form to be provided should open up the possibility of being able to largely dispense with upstream formulation steps. In particular, the use of the anionic surfactants in their acid form should be possible without having to convert them beforehand into neutralized granules.

DESCRIPTION OF THE INVENTION

The present invention provides, in a first embodiment, a detergent or cleaner shaped body comprising a viscoelastic phase whose storage modulus is between 40 000 and 800 000 Pa.

Viscoelastic substances are categorized between solids and liquids. Whereas for an ideally elastic solid, with any deformations, the stress is directly proportional to the elongation and independent of the rate of deformation (Hooke's law), Newton's law applies to an ideally viscous liquid, i.e. the stress in a linear shear gradient is proportional to the rate of deformation, but independent of the amount of deformation.

Viscoelastic substances have both viscous and also elastic behavior, the elastic part of a deformation acting on a viscoelastic substance being described by the storage modulus, while the viscous part is referred to as loss modulus. The storage modulus G' and the loss modulus G" can be correlated with the deformation work which is reversibly stored or irreversibly dissipated per stress cycle.

The elastic and viscous parts of a reaction of viscoelastic substances to defined velocity gradients are determined in dynamic viscometers with a Couette measurement system. These measurement systems can have different structures. Depending on the viscosity and amount of the substance to be investigated, cylinder/cylinder measurement systems, plate/plate measurement systems or cone/plate measurement systems can be used.

In a coaxial cylinder measurement system, the outer cylinder is subjected to an oscillating movement during which the angular velocity of the outer cylinder changes sinusoidally with time. A substance located in the annular gap between outer cylinder and inner cylinder receives from the outer cylinder a velocity gradient whose oscillation varies depending on frequency and amplitude. Then, on the inner cylinder, a resulting shear stress signal can be measured, which fluctuates with the same frequency, but has a different amplitude and, relative to the starting signal on the outer cylinder, is phase-shifted to a greater or lesser degree. The differences between the input signal on the outer cylinder and the exit signal on the inner cylinder are influenced inter alia by the elastic component.

The mathematical treatment of the data permits the determination of the storage modulus G' and of the loss modulus G". G' is a measure of the energy stored in the measurement substance and thus of the elastic component, whereas G" is a measure of the energy which is converted into heat in viscous flow and is thus lost.

Storage modulus and loss modulus measurements can be carried out in coaxial cylinder systems, for example using a computer-aided HAAKE Rotovisco RV 20 with the measurement system CV 100 at 20° C. (Couette system).

In the case of the measurement system comprising two opposite plates, one plate is subjected to an oscillating movement, the velocity of the plate changing sinusoidally with time. A substance located in the gap between the plates receives from the exciter plate a velocity gradient whose oscillation varies depending on the frequency and amplitude. A resulting shear stress signal can then be measured on the measurement plate, which signal fluctuates with the same frequency, but has a different amplitude and, relative to the input signal on the exciter plate, is phase-shifted to a greater or lesser extent. The differences between the input signal on the exciter plate and the output signal on the measurement plate are influenced inter alia by the elastic component.

For the purposes of the present invention, the measurements of the parameters G' and G" were carried out using the rheometer UDS 2000 from Paar Physika in accordance with the plate-plate 25 mm measurement system, 2 mm gap, at 20° C.

Preferably, the loss modulus of the viscoelastic phase is within relatively narrow limits. Preference is given here to detergent or cleaner shaped bodies according to the invention in which the storage modulus of the viscoelastic phase is 50 000 to 750 000 Pa, preferably 60 000 to 700 000 Pa, particularly preferably 70 000 to 650 000 Pa and in particular 80 000 to 600 000 Pa.

In particularly preferred products according to the invention, the loss modulus is less than the storage modulus, i.e. G'>G". Preference is given here to those detergent or cleaner shaped bodies according to the invention in which the storage modulus of the viscoelastic phase is at least twice that, preferably at least four times that, of the loss modulus.

As already mentioned above, when measuring viscoelastic substances on the measurement surface (second plate or inner cylinder), a resulting shear stress signal can be measured which fluctuates with the same frequency, but has a different amplitude and, relative to the input signal on the outer cylinder, is phase-shifted to a greater or lesser degree. In preferred embodiments of the present invention, detergent or cleaner shaped bodies are provided in which the phase shift of the viscoelastic phase is 0 to 30°, preferably 0 to 20° and in particular ≦17°.

A particular advantage of the detergent or cleaner shaped bodies according to the invention is that the advantages of a gel-like detergent (good detergency as a result of high surfactant content) can be combined with the easy handlability of solid supply forms. In this connection, the viscoelastic phase is present under customary storage conditions in a virtually solid consistency without the good solubility customary for gel detergents being lost under the washing conditions. Further general advantages for this type of detergent are the dispensation of the drying of a surfactant-containing phase following neutralization of the starting fatty acids (e.g. ABS) and the relatively great formulation flexibility. With particular advantage, the viscoelastic phase therefore comprises large amounts of surfactant(s), preferably anionic surfactant(s). Preference is given here to detergent or cleaner shaped bodies according to the invention which are characterized in that the viscoelastic phase comprises, based on its weight, 40 to 95% by weight, preferably 50 to 90% by weight, particularly preferably 60 to 85% by weight and in particular 65 to 82% by weight, of surfactant(s).

In textile detergents, the anionic surfactants are the most important class of surfactant, whereas these are only of minor importance in cleaners for machine dishwashing. With particular advantage, therefore, anionic surfactants are used in products according to the invention which are prepared for textile washing. Here, it is of particular advantage that the invention permits the use of unneutralized raw materials which are further processed directly to give the viscoelastic phase, without having to be converted beforehand into granules or the like by time-consuming and costly processing steps.

The anionic surfactants in acid form used are preferably one or more substances from the group of carboxylic acids, sulfuric monoesters or sulfonic acids, preferably from the group of fatty acids, fatty alkylsulfuric acids and alkylarylsulfonic acids. In order to have adequate surface-active properties, said compounds should have relatively long-chain hydrocarbon radicals, i.e. have at least 6 carbon atoms in the alkyl or alkenyl radical. Usually, the C chain distributions of the anionic surfactants are in the range from 6 to 40, preferably 8 to 30 and in particular 12 to 22, carbon atoms.

Carboxylic acids which are used in the form of their alkali metal salts as soaps in detergents and cleaners are obtained industrially for the most part from natural fats and oils by hydrolysis. Whereas the alkaline saponification, which was carried out as early as in the previous century, led directly to the alkali metal salts (soaps), only water is used industrially nowadays for the hydrolysis, which hydrolyzes the fats into glycerol and the free fatty acids. Processes used industrially are, for example, hydrolysis in autoclaves or continuous high-pressure hydrolysis. For the purposes of the present invention, carboxylic acids which can be used as anionic surfactant in acid form are, for example, hexanoic acid (caproic acid), heptanoic acid (enanthic acid), octanoic acid (caprylic acid), nonanoic acid (pelargonic acid), decanoic acid (capric acid), undecanoic acid etc. For the purposes of the present invention, preference is given to the use of fatty acids, such as dodecanoic acid (lauric acid), tetradecanoic acid (myristic acid), hexadecanoic acid (palmitic acid), octadecanoic acid (stearic acid), eicosanoic acid (arachic acid), docosanoic acid (behenic acid), tetracosanoic acid (lignoceric acid), hexacosanoic acid (cerotinic acid), triacotanoic acid (melissic acid), and the unsaturated species 9c-hexadecenoic acid (palmitoleic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid). For reasons of cost, it is preferred to use not the pure species, but technical-grade mixtures of the individual acids, as are accessible from the hydrolysis of fat. Such mixtures are, for example, coconut oil fatty acid (about 6% by weight of $C_8$, 6% by weight of $C_{10}$, 48% by weight of $C_{12}$, 18% by weight of $C_{14}$, 10% by weight of $C_{16}$, 2% by weight of $C_{18}$, 8% by weight of $C_{18'}$, 1% by weight of $C_{18''}$), palm kernel oil fatty acid (about 4% by weight of $C_8$, 5% by weight of $C_{10}$, 50% by weight of $C_{12}$, 15% by weight of $C_{14}$, 7% by weight of $C_{16}$, 2% by weight of $C_{18}$, 15% by weight of $C_{18'}$, 1% by weight of $C_{18''}$), tallow fatty acid (about 3% by weight of $C_{14}$, 26% by weight of $C_{16}$, 2% by weight of $C_{16'}$, 2% by weight of $C_{17}$, 17% by weight of $C_{18}$, 44% by weight of $C_{18'}$, 3% by weight of $C_{18''}$, 1% by weight of $C_{18'''}$), hydrogenated tallow fatty acid (about 2% by weight of $C_{14}$, 28% by weight of $C_{16}$, 2% by weight of $C_{17}$, 63% by weight of $C_{18}$, 1% by weight of $C_{18'}$), technical-grade oleic acid (about 1% by weight of $C_{12}$, 3% by weight of $C_{14}$, 5% by weight of $C_{16}$, 6% by weight of $C_{16'}$, 1% by weight of $C_{17}$, 2% by weight of $C_{18}$, 70% by weight of $C_{18'}$, 10% by weight of $C_{18''}$, 0.5% by weight of $C_{18'''}$), technical-grade palmitic/stearic acid (about 1% by weight of $C_{12}$, 2% by weight of $C_{14}$, 45% by weight of $C_{16}$, 2% by weight of $C_{17}$, 47% by weight of $C_{18}$, 1% by weight of $C_{18'}$), and soybean oil fatty acid (about 2% by weight of $C_{14}$, 15% by weight of $C_{16}$, 5% by weight of $C_{18}$, 25% by weight of $C_{18'}$, 45% by weight of $C_{18''}$, 7% by weight of $C_{18'''}$).

Sulfuric monoesters of relatively long-chain alcohols are likewise anionic surfactants in their acid form and can be used for the purposes of the process according to the invention. Their alkali metal salts, in particular sodium salts, the fatty alcohol sulfates, are accessible industrially from fatty alcohols, which are reacted with sulfuric acid, chlorosulfonic acid, amidosulfonic acid or sulfur trioxide to give the alkylsulfuric acids in question, and are subsequently neutralized. The fatty alcohols are obtained here from the corresponding fatty acids or fatty acid mixtures by high-pressure hydrogenation of the fatty acid methyl esters. The industrial process for the preparation of fatty alkylsulfuric acids which is of most significance in terms of quantities is the sulfation of the alcohols with $SO_3$/air mixtures in special cascade, falling-film or tube-bundle reactors.

A further class of anionic surfactant acids which can be used according to the invention are the alkyl ether sulfuric acids, whose salts, the alkyl ether sulfates, are characterized by higher solubility in water and lower sensitivity toward water hardness (solubility of the Ca salts) compared to the alkyl sulfates. Alkyl ether sulfuric acids are synthesized like the alkylsulfuric acids from fatty alcohols, which are reacted with ethylene oxide to give the corresponding fatty alcohol ethoxylates. Instead of ethylene oxide, propylene oxide can also be used. The subsequent sulfonation with gaseous sulfur trioxide in short-path sulfation reactors produces yields greater than 98% of the corresponding alkyl ether sulfuric acids.

Alkanesulfonic acids and olefinsulfonic acids can also be used as anionic surfactants in acid form for the purposes of the present invention. Alkanesulfonic acids can contain the sulfonic acid group terminally bonded (primary alkanesulfonic acids) or along the carbon chain (secondary alkanesulfonic acids), only the secondary alkanesulfonic acids being of commercial importance. These are prepared by sulfochlorination or sulfoxidation of linear hydrocarbons. During the sulfochlorination in accordance with Reed, n-paraffins are reacted with sulfur dioxide and chlorine with irradiation with UV light to give the corresponding sulfochlorides which, upon hydrolysis with alkalis, directly produce the alkanesulfonates, upon reaction with water the alkanesulfonic acids. Since di- and polysulfochlorides and also chlorinated hydrocarbons can arise as by-products of the free-radical reaction during the sulfochlorination, the reaction is usually carried out only up to degrees of conversion of 30% and then terminated.

Another process for the preparation of alkanesulfonic acids is sulfoxidation, in which n-paraffins are reacted with sulfur dioxide and oxygen under irradiation with UV light. In this free-radical reaction, successive alkylsulfonyl radicals are formed, which further react with oxygen to give the alkylpersulfonyl radicals. The reaction with unreacted paraffin produces an alkyl radical and the alkylpersulfonic acid, which decomposes into an alkylperoxysulfonyl radical and a hydroxy radical. The reaction of the two radicals with unreacted paraffin produces the alkylsulfonic acids or water, which reacts with alkylpersulfonic acid and sulfur dioxide to give sulfuric acid. In order to keep the yield of the two end products alkylsulfonic acid and sulfuric acid as high as possible and to suppress secondary reactions, this reaction is usually only carried out up to degrees of conversion of 1% and then terminated.

Olefinsulfonates are prepared industrially by the reaction of α-olefins with sulfur trioxide. During this process, zwitterions form as intermediate, which cyclize to give so-called sultones. Under suitable conditions (alkaline or acidic hydrolysis), these sultones react to give hydroxyalkanesulfonic acids or alkenesulfonic acids, both of which can likewise be used as anionic surfactant acids.

Alkylbenzenesulfonates, being high-performance anionic surfactants, have been known since the thirties of this century. Then, monochlorination of Kogasin fractions and subsequent Friedel-Crafts alkylation were used to produce alkylbenzenes which were sulfonated with oleum and neutralized with sodium hydroxide solution. At the start of the fifties, for the preparation of alkylbenzenesulfonates, propylene was tetramerized to give branched α-dodecylene, and the product was reacted via a Friedel-Crafts reaction using aluminum trichloride or hydrogen fluoride to give tetrapropylenebenzene, which was subsequently sulfonated and neutralized. This economic possibility for the preparation of tetrapropylenebenzenesulfonates (TPS) led to the breakthrough for this class of surfactant, which subsequently replaced soaps as the main surfactant in detergents and cleaners.

Due to the inadequate biodegradability of TPS, there was the need to prepare novel alkylbenzenesulfonates which are characterized by improved ecological behavior. These requirements are satisfied by linear alkylbenzenesulfonates, which are nowadays the almost exclusively prepared alkylbenzenesulfonates and are denoted by the abbreviation ABS or LAS.

Linear alkylbenzenesulfonates are prepared from linear alkylbenzenes, which in turn are accessible from linear olefins. For this, petroleum fractions are separated industrially into the n-paraffins of the desired purity using molecular sieves and dehydrogenated to give the n-olefins, resulting in both α- and also i-olefins. The resulting olefins are then reacted in the presence of acidic catalysts with benzene to give the alkylbenzenes, the choice of Friedel-Craft catalyst having an influence on the isomer distribution of the resulting linear alkylbenzenes: when aluminum trichloride is used, the content of the 2-phenyl isomers in the mixture with the 3-, 4-, 5- and other isomers is about 30% by weight; if on the other hand hydrogen fluoride is used as catalyst, the content of 2-phenyl isomer drops to about 20% by weight. Finally, the sulfonation of the linear alkylbenzenes takes place nowadays industrially with oleum, sulfuric acid or gaseous sulfur trioxide, the latter being by far the most important. For the sulfonation, special film or tube-bundle reactors are used which produce, as product, a 97% strength by weight alkylbenzenesulfonic acid (ABSA), which can be used as anionic surfactant acid for the purposes of the present invention.

Through the choice of neutralizing agent it is possible to obtain a very wide variety of salts, i.e. alkylbenzenesulfonates, from the ABSA. For reasons of cost, it is preferred to prepare and use the alkali metal salts and, among these, preferably the sodium salts of the ABSA. These can be described by the general formula I:

(I)

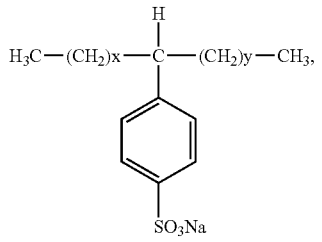

in which the sum of x and y is usually between 5 and 13. Preferred anionic surfactants in acid form according to the invention are $C_{8-16}$-, preferably $C_{9-13}$-, alkylbenzenesulfonic acids. For the purposes of the present invention, it is also preferred to use $C_{8-16}$-, preferably $C_{9-13}$-, alkylbenzenesulfonic acids which are derived from alkylbenzenes which have a tetralin content below 5% by weight, based on the alkylbenzene. It is further preferred to use alkylbenzenesulfonic acids whose alkylbenzenes have been prepared by the HF process, so that the $C_{8-16}$-, preferably $C_{9-13}$-, alkylbenzenesulfonic acids used have a content of 2-phenyl isomer below 22% by weight, based on the alkylbenzenesulfonic acid.

The abovementioned anionic surfactants in their acid form can be used on their own or in a mixture with one another. It is, however, also possible and preferred for further, preferably acidic, ingredients of detergents and cleaners to be mixed into the anionic surfactant in acid form prior to it being converted to the viscoelastic phase, in amounts of from 0.1 to 40% by weight, preferably from 1 to 15% by weight and in particular from 2 to 10% by weight, in each case based on the weight of the mixture to be reacted.

As well as the surfactant acids, suitable acidic reactants for the purposes of the present invention are also said fatty acids, phosphonic acids, polymer acids or partially neutralized polymer acids, and "builder acids" and "complex builder acids" (details later in the text) on their own and in any mixtures. Suitable ingredients of detergents and cleaners are primarily acidic detergent and cleaner ingredients, i.e., for example, phosphonic acids which, in neutralized form (phosphonates) as incrustation inhibitors, are a constituent of many detergents and cleaners. The use of (partially neutralized) polymer acids, such as, for example, polyacrylic acids, is also possible according to the invention. It is, however, also possible to mix acid-stable ingredients with the anionic surfactant acid. Suitable for this purpose are, for example, so-called small components, which would otherwise have to be added in complex further steps, i.e., for example, optical brighteners, dyes etc., it being necessary to check the acid stability in individual cases.

For the purposes of the present invention, particular preference is given to detergent or cleaner shaped bodies whose viscoelastic phase comprises, based on its weight, 40 to 85% by weight, preferably 50 to 82.5% by weight and in particular 60 to 80% by weight of alkylbenzenesulfonate(s).

The neutralized form can here be produced directly during the formation of the viscoelastic phase by mixing corresponding amounts of anionic surfactant acid, water and neutralizing agent, and optionally further ingredients. During this, the temperature increases, and the mixture is readily processable at this temperature. Upon cooling, the viscoelastic phase is formed, which is characterized by handling stability, storage stability and good solubility.

In preferred embodiments of the present invention, the viscoelastic phase additionally comprises nonionic surfactants. For cleaner shaped bodies according to the invention for machine dishwashing, these are generally individual surfactants since the abovementioned anionic surfactants are undesired in dishwashing machines due to their foaming behavior. Generally, preference is given to detergent or cleaner shaped bodies according to the invention in which the viscoelastic phase comprises, based on its weight, 0 to 20% by weight, preferably 0.5 to 15% by weight and in particular 1 to 10% by weight, of nonionic surfactant(s).

The nonionic surfactants used are preferably alkoxylated, advantageously ethoxylated, in particular primary alcohols having preferably 8 to 18 carbon atoms and on average 1 to 12 mol of ethylene oxide (EO) per mole of alcohol, in which the alcohol radical may be linear or preferably methyl-branched in the 2 position, or can contain linear and methyl-branched radicals in a mixture, as are customarily present in oxo alcohol radicals. In particular, however, preference is given to alcohol ethoxylates with linear radicals from alcohols of natural origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures thereof, such as mixtures of $C_{12-14}$-alcohol with 3 EO and $C_{12-18}$-alcohol with 5 EO. The degrees of ethoxylation given represent statistical average values which may be an integer or a fraction for a specific product. Preferred alcohol ethoxylates have a narrowed homologue distribution (narrow range ethoxylates, NRE). In addition to these nonionic surfactants, fatty alcohols with more than 12 EO can also be used. Examples thereof are tallow fatty alcohol with 14 EO, 25 EO, 30 EO or 40 EO.

In addition, further nonionic surfactants which may be used are also alkyl glycosides of the general formula $RO(G)_x$, in which R is a primary straight-chain or methyl-branched, in particular methyl-branched in the 2 position, aliphatic radical having 8 to 22 carbon atoms, preferably 12 to 18 carbon atoms, and G is the symbol which stands for a glycose unit with 5 or 6 carbon atoms, preferably glucose. The degree of oligomerization x, which gives the distribution of monoglycosides and oligoglycosides, is any desired number between 1 and 10; preferably x is 1.2 to 1.4.

A further class of preferably used nonionic surfactants, which are used either as the sole nonionic surfactant or in combination with other nonionic surfactants, are alkoxylated, preferably ethoxylated or ethoxylated and propoxylated fatty acid alkyl esters, preferably having 1 to 4 carbon atoms in the alkyl chain, in particular fatty acid methyl esters.

Nonionic surfactants of the amine oxide type, for example N-cocoalkyl-N,N-dimethylamine oxide and N-tallow-alkyl-N,N-dihydroxyethylamine oxide, and of the fatty acid alkanolamide type, may also be suitable. The amount of these nonionic surfactants is preferably not more than that of the ethoxylated fatty alcohols, in particular not more than half thereof.

Further suitable surfactants are polyhydroxy fatty acid amides of the formula II,

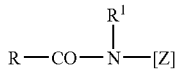

(II)

in which RCO is an aliphatic acyl radical having 6 to 22 carbon atoms, $R^1$ is hydrogen, an alkyl or hydroxyalkyl radical having 1 to 4 carbon atoms and [Z] is a linear or branched polyhydroxyalkyl radical having 3 to 10 carbon atoms and 3 to 10 hydroxyl groups. The polyhydroxy fatty acid amides are known substances which can customarily be obtained by reductive amination of a reducing sugar with ammonia, an alkylamine or an alkanolamine, and subsequent acylation with a fatty acid, a fatty acid alkyl ester or a fatty acid chloride.

The group of polyhydroxy fatty acid amides also includes compounds of the formula III,

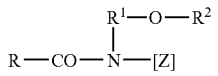

(III)

in which R is a linear or branched alkyl or alkenyl radical having 7 to 12 carbon atoms, $R^1$ is a linear, branched or cyclic alkyl radical or an aryl radical having 2 to 8 carbon atoms, and $R^2$ is a linear, branched or cyclic alkyl radical or an aryl radical or an oxy-alkyl radical having 1 to 8 carbon atoms, where $C_{1-4}$-alkyl or phenyl radicals are preferred and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, for example glucose, fructose, maltose, lactose, galactose, mannose or xylose. The N-alkoxy- or N-aryloxy-substituted compounds may then be converted into the desired polyhydroxy fatty acid amides by reaction with fatty acid methyl esters in the presence of an alkoxide as catalyst.

For the purposes of the present invention, preference is given to detergent or cleaner shaped bodies which comprise anionic and nonionic surfactant(s), where performance advantages can result from certain quantitative ratios in which the individual surfactant classes are used.

Thus, for example, particular preference is given to detergent and cleaner shaped bodies in which the ratio of anionic surfactant(s) to nonionic surfactant(s) is between 10:1 and 1:10, preferably between 7.5:1 and 1:5 and in particular between 5:1 and 1:2. Preference is also given to detergent and cleaner shaped bodies which comprise surfactant(s), preferably anionic and/or nonionic surfactant(s), in amounts of from 5 to 40% by weight, preferably from 7.5 to 35% by weight, particularly preferably from 10 to 30% by weight and in particular from 12.5 to 25% by weight, in each case based on the weight of the shaped body.

From the point of view of performance, it may be advantageous if certain surfactant classes are not present in some phases of the detergent and cleaner shaped bodies or in the entire shaped body, i.e. in all phases. A further important embodiment of the present invention therefore provides for at least one phase of the shaped body being free from nonionic surfactants.

Conversely, however, a positive effect can also be achieved through the content of individual phases or of the entire shaped body, i.e. of all phases. The incorporation of the alkyl polyglycosides described above has proven to be advantageous here, meaning that preference is given to detergent and cleaner shaped bodies in which at least one phase of the shaped body comprises alkyl polyglycosides.

Similarly to the case of nonionic surfactants, the omission of anionic surfactants from individual phases or all of the phases may also result in detergent and cleaner shaped bodies which are more suitable for certain fields of use. Within the scope of the present invention, detergent and cleaner shaped bodies are also conceivable in which at least one phase of the shaped body is free from anionic surfactants.

As already mentioned, the use of surfactants in cleaner tablets for machine dishwashing is preferably limited to the use of nonionic surfactants in small amounts. For the purposes of the present invention, detergent and cleaner shaped bodies to be used with preference as cleaner tablets are characterized in that they have total surfactant contents below 5% by weight, preferably below 4% by weight, particularly preferably below 3% by weight and in particular below 2% by weight, in each case based on their total weight. The surfactants used in machine dishwashing agents are usually merely low-foaming nonionic surfactants. Representatives from the group of anionic, cationic or amphoteric surfactants are, by contrast, of lesser importance. Cleaner shaped bodies according to the invention for machine dishwashing particularly advantageously comprise nonionic surfactants, in particular nonionic surfactants from the group of alkoxylated alcohols. The nonionic surfactants used are preferably alkoxylated, advantageously ethoxylated, in particular primary alcohols having preferably 8 to 18 carbon atoms and on average 1 to 12 mol of ethylene oxide (EO) per mole of alcohol, in which the alcohol radical may be linear or preferably methyl-branched in the 2 position, or may contain linear and methyl-branched radicals in a mixture, as are customarily present in oxo alcohol radicals. Particular preference is given, however, to alcohol ethoxylates with linear radicals from alcohols of natural origin having 12 to 18 carbon atoms, e.g. from coconut alcohol, palm alcohol, tallow fatty alcohol or oleyl alcohol, and on average 2 to 8 EO per mole of alcohol. Preferred ethoxylated alcohols include, for example, $C_{12-14}$-alcohols with 3 EO or 4 EO, $C_{9-11}$-alcohol with 7 EO, $C_{13-15}$-alcohols with 3 EO, 5 EO, 7 EO or 8 EO, $C_{12-18}$-alcohols with 3 EO, 5 EO or 7 EO and mixtures thereof, such as mixtures of $C_{12-14}$-alcohol with 3 EO and $C_{12-18}$-alcohol with 5 EO. The degrees of ethoxylation given represent statistical average values, which may be an integer or a fraction for a specific product. Preferred alcohol ethoxylates have a narrowed homolog distribution (narrow range ethoxylates, NRE). In addition to these nonionic surfactants, fatty alcohols with more than 12 EO can also be used. Examples thereof are tallow fatty alcohol with 14 EO, 25 EO, 30 EO or 40 EO.

For detergent shaped bodies or cleaner shaped bodies according to the invention for machine dishwashing in particular, it is preferred for the detergent and cleaner shaped bodies to comprise a nonionic surfactant which has a melting point above room temperature, preferably a nonionic surfactant with a melting point above 20° C. Nonionic surfactants which are to be used with preference have melting points above 25° C., nonionic surfactants which are to be used particularly preferably have melting points between 25 and 60° C., in particular between 26.6 and 43.3° C.

Suitable nonionic surfactants which have melting points or softening points within the stated temperature range are, for example, low-foaming nonionic surfactants which may be solid or highly viscous at room temperature. If nonionic surfactants which are highly viscous at room temperature are used, then it is preferred that they have a viscosity above 20 Pas, preferably above 35 Pas, and in particular above 40 Pas. Nonionic surfactants which have a wax-like consistency at room temperature are also preferred.

Preferred nonionic surfactants that are solid at room temperature originate from the groups of alkoxylated nonionic surfactants, in particular ethoxylated primary alcohols and mixtures of these surfactants with surfactants of more complex structure, such as polyoxypropylene/polyoxyethylene/polyoxypropylene (PO/EO/PO) surfactants. Such (PO/EO/PO) nonionic surfactants are characterized, moreover, by good foam control.

In a preferred embodiment of the present invention, the nonionic surfactant with a melting point above room temperature is an ethoxylated nonionic surfactant originating from the reaction of a monohydroxyalkanol or alkylphenol having 6 to 20 carbon atoms with preferably at least 12 mol, particularly preferably at least 15 mol, in particular at least 20 mol, of ethylene oxide per mole of alcohol or alkylphenol.

A particularly preferred nonionic surfactant that is solid at room temperature is obtained from a straight-chain fatty alcohol having 16 to 20 carbon atoms ($C_{16-20}$-alcohol), preferably a $C_{18}$-alcohol and at least 12 mol, preferably at least 15 mol and in particular at least 20 mol, of ethylene oxide. Of these, the so-called "narrow range ethoxylates" (see above) are particularly preferred.

The nonionic surfactant which is solid at room temperature preferably additionally has propylene oxide units in the molecule. Preferably, such PO units account for up to 25% by weight, particularly preferably up to 20% by weight and in particular up to 15% by weight, of the overall molar mass of the nonionic surfactant. Particularly preferred nonionic surfactants are ethoxylated monohydroxyalkanols or alkylphenols which additionally have polyoxyethylene-polyoxypropylene block copolymer units. The alcohol or alkylphenol moiety of such nonionic surfactant molecules accounts for preferably more than 30% by weight, particularly preferably more than 50% by weight and in particular more than 70% by weight, of the overall molar mass of such nonionic surfactants.

Further nonionic surfactants with melting points above room temperature which can particularly preferably be used comprise 40 to 70% of a polyoxypropylene/polyoxyethylene/polyoxypropylene block polymer blend which comprises 75% by weight of an inverted block copolymer of polyoxyethylene and polyoxypropylene with 17 mol of ethylene oxide and 44 mol of propylene oxide and 25% by weight of a block copolymer of polyoxyethylene and polyoxypropylene, initiated with trimethylolpropane and comprising 24 mol of ethylene oxide and 99 mol of propylene oxide per mole of trimethylolpropane.

Nonionic surfactants which may be used with particular preference are available, for example, under the name Poly Tergent® SLF-18 from Olin Chemicals.

A further preferred surfactant may be described by the formula $$R^1O[CH_2CH(CH_3)O]_x[CH_2CH_2O]_y[CH_2CH(OH)R^2]$$

in which $R^1$ is a linear or branched aliphatic hydrocarbon radical having 4 to 18 carbon atoms or mixtures thereof, $R^2$ is a linear or branched hydrocarbon radical having 2 to 26 carbon atoms or mixtures thereof, and x represents values between 0.5 and 1.5 and y represents a value of at least 15.

Further nonionic surfactants which can preferably be used are the terminally capped poly(oxyalkylated) nonionic surfactants of the formula $$R^1O[CH_2CH(R^3)O]_x[CH_2]_kCH(OH)[CH_2]_jOR^2$$

in which $R^1$ and $R^2$ are linear or branched, saturated or unsaturated, aliphatic or aromatic hydrocarbon radicals having 1 to 30 carbon atoms, $R^3$ is H or a methyl, ethyl, n-propyl, isopropyl, n-butyl, 2-butyl or 2-methyl-2-butyl radical, x represents values between 1 and 30, k and j represent values between 1 and 12, preferably between 1 and 5. If the value x is $\geqq 2$, each $R^3$ in the above formula may be different. $R^1$ and $R^2$ are preferably linear or branched, saturated or unsaturated, aliphatic or aromatic hydrocarbon radicals having 6 to 22 carbon atoms, radicals having 8 to 18 carbon atoms being particularly preferred. For the radical $R^3$, H, —$CH_3$ or —$CH_2CH_3$ are particularly preferred. Particularly preferred values for x are in the range from 1 to 20, in particular from 6 to 15.

As described above, each $R^3$ in the above formula may be different if x is $\geqq 2$. This means it is possible to vary the alkylene oxide unit in the square brackets. If x, for example, is 3, the radical $R^3$ may be selected in order to form ethylene oxide ($R^3$H) or propylene oxide ($R^3$=$CH_3$) units, which may be added onto one another in any sequence, examples being (EO) (PO) (EO), (EO)(EO)(PO), (EO)(EO)(EO), (PO)(EO)(PO), (PO)(PO)(EO) and (PO) (PO) (PO). The value 3 for x has been chosen here by way of example and it is entirely possible for it to be larger, the scope for variation increasing with increasing values of x and embracing, for example, a large number of (EO) groups, combined with a small number of (PO) groups, or vice versa.

Particularly preferred terminally capped poly(oxyalkylated) alcohols of the above formula have values of K=1 and j=1, so that the above formula is simplified to $$R^1O[CH_2CH(R^3)O]_xCH_2CH(OH)CH_2OR^2.$$

In the last-mentioned formula, $R^1$, $R^2$ and $R^3$ are as defined above and X represents numbers from 1 to 30, preferably from 1 to 20 and in particular from 6 to 18. Surfactants which are particularly preferred are those in which the radicals $R^1$ and $R^2$ have 9 to 14 carbon atoms, $R^3$ represents H and X assumes values of 6 to 15.

Further ingredients which may be a constituent of the viscoelastic phase (for examples bleaches, bleach activators, enzymes, dyes and fragrances, optical brighteners etc.) are described below.

From the consumers' point of view, products according to the invention which contain at least one tableted phase as well as at least one viscoelastic phase are particularly attractive, for which reason detergent or cleaner shaped bodies according to the invention which additionally have at least one tableted phase which, based on its weight, comprises 10 to 80% by weight, preferably 20 to 75% by weight and in particular 30 to 70% by weight, of builder(s) are preferred.

These detergent or cleaner shaped bodies according to the invention comprise, at least in the tableted phase, builders, which preferably originate from the groups of zeolites, silicates, carbonates, hydrogencarbonates, phosphates and polymers.

Alkali metal phosphates is the collective term for the alkali metal (in particular sodium and potassium) salts of the various phosphoric acids, among which metaphosphoric acids $(HPO_3)_n$ and orthophosphoric acid $H_3PO_4$, in addition to higher molecular weight representatives, may be differentiated. The phosphates combine a number of advantages: they act as alkali carriers, prevent limescale deposits on machine components, and lime incrustations in fabrics, and additionally contribute to the cleaning performance.

Sodium dihydrogenphosphate, $NaH_2PO_4$, exists as the dihydrate (density 1.91 $gcm^{-3}$, melting point 600) and as the monohydrate (density 2.04 $gcm^{-3}$). Both salts are white powders which are very readily soluble in water, which lose the water of crystallization upon heating and undergo conversion at 200° C. into the weakly acidic diphosphate (disodium hydrogendiphosphate, $Na_2H_2P_2O_7$), at a higher temperature into sodium trimetaphosphate ($Na_3P_3O_9$) and Maddrell's salt (see below). $NaH_2PO_4$ is acidic; it is formed if phosphoric acid is adjusted to a pH of 4.5 using sodium hydroxide solution and the slurry is sprayed. Potassium dihydrogenphosphate (primary or monobasic potassium phosphate, potassium biphosphate, PDP), $KH_2PO_4$, is a white salt of density 2.33 $gcm^{-3}$, has a melting point of 2530 [decomposition with the formation of potassium polyphosphate $(KPO_3)_x$] and is readily soluble in water.

Disodium hydrogenphosphate (secondary sodium phosphate), $Na_2HPO_4$, is a colorless, very readily water-soluble crystalline salt. It exists in anhydrous form and with 2 mol of water (density 2.066 $gcm^{-3}$, water loss at 95°), 7 mol of water (density 1.68 $gcm^{-3}$, melting point 48° with loss of $5H_2O$) and 12 mol of water (density 1.52 $gcm^{-3}$, melting point 35° with loss of $5H_2O$), becomes anhydrous at 1000 and converts to the diphosphate $Na_4P_2O_7$ upon more severe heating. Disodium hydrogenphosphate is prepared by neutralizing phosphoric acid with soda solution using phenolphthalein as indicator. Dipotassium hydrogenphosphate (secondary or dibasic potassium phosphate), $K_2HPO_4$, is an amorphous white salt which is readily soluble in water.

Trisodium phosphate, tertiary sodium phosphate, $Na_3PO_4$, are colorless crystals which as the dodecahydrate have a density of 1.62 $gcm^{-3}$ and a melting point of 73-76° C. (decomposition), as the decahydrate (corresponding to 19-20% of $P_2O_5$) have a melting point of 100° C. and in anhydrous form (corresponding to 39-40% of $P_2O_5$) have a density of 2.536 $gcm^{-3}$. Trisodium phosphate is readily soluble in water with an alkaline reaction and is prepared by evaporative concentration of a solution of exactly 1 mol of disodium phosphate and 1 mol of NaOH. Tripotassium phosphate (tertiary or tribasic potassium phosphate), $K_3PO_4$, is a white, deliquescent, granular powder of density 2.56 $gcm^{-3}$, has a melting point of 1340° and is readily soluble in water with an alkaline reaction. It is produced, for example, when Thomas slag is heated with charcoal and potassium sulfate. Despite the relatively high price, the more readily soluble and therefore highly effective potassium phosphates are often preferred in the cleaners industry over corresponding sodium compounds.

Tetrasodium diphosphate (sodium pyrophosphate), $Na_4P_2O_7$, exists in anhydrous form (density 2.534 $gcm^{-3}$, melting point 988°, 880° also reported) and as the decahydrate (density 1.815-1.836 $gcm^{-3}$, melting point 94° with loss of water). Both substances are colorless crystals which are soluble in water with an alkaline reaction. $Na_4P_2O_7$ is formed when disodium phosphate is heated at >200° or by reacting phosphoric acid with soda in the stoichiometric ratio and dewatering the solution by spraying. The decahydrate complexes heavy metal salts and water hardness constituents and therefore reduces the hardness of the water. Potassium diphosphate (potassium pyrophosphate), $K_4P_2O_7$, exists in the form of the trihydrate and is a colorless, hygroscopic powder with a density of 2.33 $gcm^{-3}$ which is soluble in water, the pH of the 1% strength solution at 25° being 10.4.

Condensation of the $NaH_2PO_4$ or of the $KH_2PO_4$ gives rise to higher molecular weight sodium and potassium phosphates, among which it is possible to differentiate between cyclic representatives, the sodium and potassium metaphosphates, and catenated types, the sodium and potassium polyphosphates. For the latter, in particular, a large number of names are in use: fused or calcined phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the anhydrous salt dissolve in 100 g of water at room temperature, about 20 g dissolve at 60°, and about 32 g dissolve at 100°; after heating the solution for two hours at 100°, about 8% orthophosphate and 15% diphosphate are produced by hydrolysis. In the case of the preparation of pentasodium triphosphate, phosphoric acid is reacted with soda solution or sodium hydroxide solution in the stoichiometric ratio and the solution is dewatered by spraying. Similarly to Graham's salt and sodium diphosphate, pentasodium triphosphate dissolves many insoluble metal compounds (including lime soaps, etc.). Pentapotassium triphosphate, $K_5P_3O_{10}$ (potassium tripolyphosphate), is commercially available, for example, in the form of a 50% strength by weight solution (>23% $P_2O_5$, 25% $K_2O$). The potassium polyphosphates are widely used in the detergents and cleaners industry. There also exist sodium potassium tripolyphosphates, which can likewise be used within the scope of the present invention. These form, for example, when sodium trimetaphosphate is hydrolyzed with KOH:

$$(NaPO_3)_3+2KOH \rightarrow Na_3K_2P_3O_{10}+H_2O.$$

These phosphates can be used in accordance with the invention in exactly the same way as sodium tripolyphosphate, potassium tripolyphosphate or mixtures of the two; according to the invention, it is also possible to use mixtures of sodium tripolyphosphate and sodium potassium tripolyphosphate or mixtures of potassium tripolyphosphate and sodium potassium tripolyphosphate or mixtures of sodium tripolyphosphate and potassium tripolyphosphate and sodium potassium tripolyphosphate.

Further ingredients which may be present instead of or in addition to phosphates in the detergent or cleaner shaped bodies are carbonates and/or hydrogencarbonates, where the alkali metal salts, and of these particularly the potassium and/or sodium salts, are preferred. Preferred detergent or cleaner shaped bodies comprise carbonate(s) and/or hydrogencarbonate(s), preferably alkali metal carbonates, particularly preferably sodium carbonate, in amounts of from 5 to 50% by weight, preferably from 7.5 to 40% by weight and in particular from 10 to 30% by weight, in each case based on a tableted phase.

Further ingredients which may be present instead of or in addition to said phosphates and/or carbonates/hydrogencarbonates in the detergent or cleaner shaped bodies according to the invention are silicates, where the alkali metal silicates, and of these particularly the amorphous and/or crystalline potassium and/or sodium disilicates, are preferred.

Suitable crystalline, layered sodium silicates have the general formula $NaMSi_xO_{2x+1}.yH_2O$, where M is sodium or hydrogen, x is a number from 1.9 to 4 and y is a number from 0 to 20, and preferred values for x are 2, 3 or 4. Preferred crystalline phyllosilicates of the given formula are those in which M is sodium and x assumes the values 2 or 3. In particular, both β- and δ-sodium disilicates $Na_2Si_2O_5.yH_2O$ are preferred.

It is also possible to use amorphous sodium silicates having an $Na_2O:SiO_2$ modulus of from 1:2 to 1:3.3, preferably from 1:2 to 1:2.8 and in particular from 1:2 to 1:2.6, which have delayed solubility and secondary detergency properties. The dissolution delay relative to conventional amorphous sodium silicates can have been induced in various ways, for example by surface treatment, compounding, compaction/compression or by overdrying. Within the scope of this invention, the term "amorphous" also means "X-ray-amorphous". This means that, in X-ray diffraction experiments, the silicates do not give sharp X-ray reflections typical of crystalline substances, but, at best, one or more maxima of the scattered X-ray radiation, which have a width of several degree units of the angle of diffraction. However, it is very probable that particularly good builder properties may result if, in electron diffraction experiments, the silicate particles give poorly defined or even sharp diffraction maxima. This is to be interpreted to the effect that the products have microcrystalline regions of size 10 to a few hundred nm, values up to a maximum of 50 nm and in particular up to a maximum of 20 nm being preferred. Particular preference is given to compressed/compacted amorphous silicates, compounded amorphous silicates and overdried X-ray-amorphous silicates.

Detergent or cleaner shaped bodies preferred for the purposes of the present invention comprise silicate(s), preferably alkali metal silicates, particularly preferably crystalline or amorphous alkali metal disilicates, in amounts of from 3 to 60% by weight, preferably from 15 to 50% by weight and in particular from 20 to 40% by weight, in each case based on the mass of the tableted phase(s).

Likewise suitable as important components in the detergent and cleaner shaped bodies according to the invention are substances from the group of zeolites. In the case of detergent tablets in particular, these substances represent preferred builders. Zeolites have the general formula $$M_{2/n}O.Al_2O_3xSiO_2.yH_2O$$

in which M is a cation of the valency n, x represents values which are greater than or equal to 2 and y can assume values between 0 and 20. The zeolite structures are formed as a result of the linkage of $AlO_4$ tetrahedra with $SiO_4$ tetrahedra, this network being occupied by cations and water molecules. The cations in these structures are relatively mobile and can be exchanged for other cations to varying degrees. The intercrystalline "zeolitic" water can, depending on the type of zeolite, be continuously and reversibly released, whereas in the case of some types of zeolite, structural changes also accompany the release or uptake of water.

Preferred detergent or cleaner shaped bodies are characterized in that they comprise zeolite(s), preferably zeolite A, zeolite P, zeolite X and mixtures of these, in amounts of from 0 to 60% by weight, preferably from 1 to 40% by weight and in particular from 3 to 30% by weight.

As well as said constituents, builder and surfactant, the detergent and cleaner shaped bodies according to the invention can comprise further ingredients customary in detergent and cleaners from the group consisting of bleaches, bleach activators, disintegration auxiliaries, dyes, fragrances, optical brighteners, enzymes, foam inhibitors, silicone oils, antiredeposition agents, graying inhibitors, color transfer inhibitors and corrosion inhibitors. Disintegration auxiliaries are preferred ingredients particularly in tableted phases.

In order to facilitate the disintegration of highly compacted shaped bodies, it is possible to incorporate disintegration auxiliaries, so-called tablet disintegrants, into the shaped bodies in order to shorten the disintegration times. Preferred detergent and cleaner shaped bodies comprise 0.5 to 10% by weight, preferably 3 to 7% by weight and in particular 4 to 6% by weight, of one or more disintegration auxiliaries, based in each case on the weight of the tableted phase(s).

Preferred disintegrants used in the context of the present invention are cellulose-based disintegrants and so preferred detergent and cleaner tablets comprise a cellulose-based disintegrant of this kind in amounts from 0.5 to 10% by weight, preferably from 3 to 7% by weight, and in particular from 4 to 6% by weight. Pure cellulose has the formal gross composition $(C_6H_{10}O_5)_n$ and, considered formally, is a β-1,4-polyacetal of cellobiose, which itself is constructed of two molecules of glucose. Suitable celluloses consist of from about 500 to 5 000 glucose units and, accordingly, have average molecular masses of from 50 000 to 500 000. Cellulose-based disintegrants which can be used also include, in the context of the present invention, cellulose derivatives obtainable by polymer-analogous reactions from cellulose. Such chemically modified celluloses include, for example, products of esterifications and etherifications in which hydroxy hydrogen atoms have been substituted. However, celluloses in which the hydroxy groups have been replaced by functional groups not attached via an oxygen atom may also be used as cellulose derivatives. The group of the cellulose derivatives embraces, for example, alkali metal celluloses, carboxymethylcellulose (CMC), cellulose esters and cellulose ethers and aminocelluloses. Said cellulose derivatives are preferably not used alone as cellulose-based disintegrants but instead are used in a mixture with cellulose. The cellulose derivative content of these mixtures is preferably less than 50% by weight, particularly preferably less than 20% by weight, based on the cellulose-based disintegrant. The particularly preferred cellulose-based disintegrant used is pure cellulose, free from cellulose derivatives.

As a further cellulose-based disintegrant or as a constituent of this component it is possible to use microcrystalline cellulose. This microcrystalline cellulose is obtained by partial hydrolysis of celluloses under conditions which attack only the amorphous regions (approximately 30% of the total cellulose mass) of the celluloses and break them up completely but leave the crystalline regions (approximately 70%) intact. Subsequent deaggregation of the microfine celluloses resulting from the hydrolysis yields the microcrystalline celluloses, which have primary particle sizes of approximately 5 μm and can be compacted, for example, to granulates having an average particle size of 200 μm.

Detergent and cleaner shaped bodies which are preferred in the context of the present invention additionally comprise a disintegration auxiliary, preferably a cellulose-based disintegration auxiliary, preferably in granular, cogranulated or compacted form, in amounts of from 0.5 to 10% by weight, preferably from 3 to 7% by weight, and in particular from 4 to 6% by weight, based in each case on the weight of the tableted phase(s).

The detergent and cleaner shaped bodies of the invention may further comprise, incorporated into one or more of the tableted phases, a gas-evolving effervescent system. The gas-evolving effervescent system may consist of a single substance which on contact with water releases a gas. Among these compounds mention may be made, in particular, of magnesium peroxide, which on contact with water releases oxygen. Normally, however, the gas-releasing effervescent system consists for its part of at least two constituents which react with one another and, in so doing, form gas. Although a multitude of systems which release, for example, nitrogen, oxygen or hydrogen are conceivable and implementable here, the effervescent system used in the detergent and cleaner shaped bodies of the invention will be selectable on the basis of both economic and ecological considerations. Preferred effervescent systems consist of alkali metal carbonate and/or alkali metal bicarbonate and of an acidifier which is suitable for releasing carbon dioxide from the alkali metal salts in aqueous solution.

Among the alkali metal carbonates and/or alkali metal hydrogencarbonates, the sodium and potassium salts are much preferred over the other salts on grounds of cost. It is of course not mandatory to use the pure alkali metal carbonates or alkali metal hydrogencarbonates in question; rather, mixtures of different carbonates and hydrogencarbonates may be preferred from the viewpoint of washing performance.

In preferred detergent and cleaner shaped bodies, the effervescent system used comprises from 2 to 20% by weight, preferably from 3 to 15% by weight, and in particular from 5 to 10% by weight, of an alkali metal carbonate or alkali metal hydrogencarbonate, and from 1 to 15, preferably from 2 to 12, and in particular from 3 to 10, % by weight of an acidifier, based in each case on the overall shaped body.

Examples of acidifiers which release carbon dioxide from the alkali metal salts in aqueous solution which may be used are boric acid and also alkali metal hydrogensulfates, alkali metal dihydrogenphosphates, and other inorganic salts. Preference is given, however, to the use of organic acidifiers, with citric acid being a particularly preferred acidifier. However, it is also possible, in particular, to use the other solid mono-, oligo- and polycarboxylic acids. Preferred among this group, in turn, are tartaric acid, succinic acid, malonic acid, adipic acid, maleic acid, fumaric acid, oxalic acid, and polyacrylic acid. Organic sulfonic acids such as amidosulfonic acid may likewise be used. A product which is commercially available and which can likewise preferably be used as acidifier in the context of the present invention is Sokalan® DCS (trademark of BASF), a mixture of succinic acid (max. 31% by weight), glutaric acid (max. 50% by weight), and adipic acid (max. 33% by weight).

In the context of the present invention, preference is given to detergent and cleaner shaped bodies where the acidifier used in the effervescent system comprises a substance from the group of the organic di-, tri- and oligocarboxylic acids, and mixtures thereof.

Among the compounds used as bleaches which yield $H_2O_2$ in water, sodium percarbonate is of particular importance. This "sodium percarbonate" is a term used unspecifically for sodium carbonate peroxohydrates, which strictly speaking are not "percarbonates" (i.e., salts of percarbonic acid) but rather hydrogen peroxide adducts with sodium carbonate. The commercial product has the average composition $2Na_2CO_3.3H_2O_2$ and is thus not a peroxycarbonate. Sodium percarbonate forms a white, water-soluble powder of density 2.14 $gcm^{-3}$ which breaks down readily into sodium carbonate and oxygen having a bleaching or oxidizing action.

Further bleaches which may be used are, for example, sodium perborate tetrahydrate and sodium perborate monohydrate, peroxypyrophosphates, citrate perhydrates, and $H_2O_2$-donating peracidic salts or peracids, such as perbenzoates, peroxophthalates, diperazelaic acid, phthaloimino peracid or diperdodecanedioic acid. Also in the case of the use of the bleaches, it is possible to dispense with the use of surfactants and/or builders, thereby making it possible to produce pure bleach tablets. If such bleach tablets are to be used for textile laundry, preference is given to a combination of sodium percarbonate with sodium sesquicarbonate, irrespective of which other ingredients are present in the shaped bodies. If cleaner tablets or bleach tablets for machine dishwashing are being produced, then the bleaches used may also be those from the group of organic bleaches. Typical organic bleaches are the diacyl peroxides, such as dibenzoyl peroxide, for example. Further typical organic bleaches are the peroxy acids, particular examples being the alkyl peroxy acids and the aryl peroxy acids. Preferred representatives are (a) peroxybenzoic acid and its ring-substituted derivatives, such as alkylperoxybenzoic acids, and also peroxy-α-naphthoic acid and magnesium monoperphthalate, (b) aliphatic or substituted aliphatic peroxy acids, such as peroxylauric acid, peroxystearic acid, ε-phthalimidoperoxycaproic acid [phthaloiminoperoxy-hexanoic acid (PAP)], o-carboxybenzamidoperoxycaproic acid, N-nonenylamidoperadipic acid and N-nonenylamido-persuccinates, and (c) aliphatic and araliphatic peroxy dicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid and N,N-tere-phthaloyldi(6-aminopercaproic acid) may be used.

Bleaches in shaped bodies for machine dishwashing may also be substances which release chlorine or bromine. Among suitable chlorine- or bromine-releasing materials, examples include heterocyclic N-bromoamides and N-chloroamides, examples being trichloroisocyanuric acid, tribromoisocyanuric acid, dibromoisocyanuric acid and/or dichloroisocyanuric acid (DICA) and/or salts thereof with cations such as potassium and sodium. Hydantoin compounds, such as 1,3-dichloro-5,5-dimethylhydantoin, are likewise suitable.

In order to achieve an improved bleaching effect when washing or cleaning at temperatures of 60° C. and below, it is possible to incorporate bleach activators. Bleach activators, which boost the action of the bleaches, are, for example, compounds containing one or more N-acyl and/or O-acyl groups, such as substances from the class of the anhydrides, esters, imides and acylated imidazoles or oximes. Examples are tetraacetylethylenediamine (TAED), tetraacetylmethylenediamine (TAMD), and tetraacetylhexylenediamine (TAHD), and also pentaacetylglucose (PAG), 1,5-diacetyl-2,2-dioxohexahydro-1,3,5-triazine (DADHT), and isatoic anhydride (ISA).

Bleach activators which may be used are compounds which under perhydrolysis conditions give rise to aliphatic peroxo carboxylic acids having preferably 1 to 10 carbon atoms, in particular 2 to 4 carbon atoms, and/or substituted or unsubstituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acyl imides, in particular N-nonanoyl-succinimide (NOSI), acylated phenolsulfonates, particular n-nonanoyl- or isononanoyloxy-benzenesulfonate (n- or iso-NOBS), carboxylic anhydrides, in particular phthalic anhydride, acylated polyhydric alcohols, in particular triacetin, ethylene glycol diacetate, 2,5-diacetoxy-2,5-dihydrofuran, n-methylmorpholiniumacetonitrile methylsulfate (MMA), and also acetylated sorbitol and mannitol and/or mixtures thereof (SORMAN), acylated sugar derivatives, in particular pentaacetylglucose (PAG), pentaacetylfructose, tetraacetylxylose and octaacetyllactose, and acetylated, optionally N-alkylated glucamine and gluconolactone, and/or N-acylated lactams, for example, N-benzoylcaprolactam. Hydrophilically substituted acylacetals and acyllactams are likewise used with preference. Combinations of conventional bleach activators may also be used.

In addition to the conventional bleach activators, or instead of them, it is also possible to incorporate so-called bleaching catalysts. These substances are bleach-boosting transition metal salts or transition metal complexes such as, for example, Mn-, Fe-, Co-, Ru- or Mo-salen complexes or -carbonyl complexes. Other bleaching catalysts which can be used include Mn, Fe, Co, Ru, Mo, Ti, V and Cu complexes with N-containing tripod ligands, and also Co-, Fe-, Cu- and Ru-ammine complexes.

Preference is given to the use of bleach activators from the group of polyacylated alkylenediamines, especially tetraacetylethylenediamine (TAED), N-acyl-imides, in particular N-nonanoylsuccinimide (NOSI), acylated phenolsulfonates, especially n-nonanoyl- or isononanoyloxybenzenesulfonate (n- or iso-NOBS), n-methylmorpholiniumacetonitrile methylsulfate (MMA), preferably in amounts of up to 10% by weight, in particular from 0.1% by weight to 8% by weight, more particularly from 2 to 8% by weight, and particularly preferably from 2 to 6% by weight, based on the overall composition.

Bleach-boosting transition metal complexes, in particular those with the central atoms Mn, Fe, Co, Cu, Mo, V, Ti and/or Ru, preferably selected from the group of manganese and/or cobalt salts and/or complexes, particularly preferably from cobalt ammine complexes, cobalt acetato complexes, cobalt carbonyl complexes, the chlorides of cobalt or manganese, and manganese sulfate, are used in customary amounts, preferably in an amount of up to 5% by weight, in particular from 0.0025% by weight to 1% by weight, and particularly preferably from 0.01% by weight to 0.25% by weight, based in each case on the overall composition. In specific cases, however, it is also possible to use a greater amount of bleach activator.

Further preferred detergent or cleaner shaped bodies for machine dishwashing are characterized in that at least one phase comprises silver protectants from the group of the triazoles, benzotriazoles, bisbenzotriazoles, aminotriazoles, alkylaminotriazoles and the transition metal salts or transition metal complexes, particularly preferably benzotriazole and/or alkylaminotriazole, in amounts of from 0.01 to 5% by weight, preferably from 0.05 to 4% by weight, and in particular from 0.5 to 3% by weight, based in each case on the mass.

Said corrosion inhibitors may likewise be incorporated in order to protect the ware or the machine, particular importance in the field of machine dishwashing being attached to silver protectants. The known substances of the prior art may be used. In general it is possible to use, in particular, silver protectants selected from the group consisting of triazoles, benzotriazoles, bisbenzotriazoles, aminotriazoles, alkylaminotriazoles, and transition metal salts or transition metal complexes. Particular preference is given to the use of benzotriazole and/or alkylaminotriazole. Frequently encountered in cleaning formulations, furthermore, are agents containing active chlorine, which may significantly reduce corrosion of the silver surface. In chlorine-free cleaners, use is made in particular of oxygen-containing and nitrogen-containing organic redox-active compounds, such as divalent and trivalent phenols, e.g. hydroquinone, pyrocatechol, hydroxylhydroquinone, gallic acid, phloroglucinol, pyrogallol, and derivatives of these classes of compound. Inorganic compounds in the form of salts and complexes, such as salts of the metals Mn, Ti, Zr, Hf, V, Co and Ce, also find frequent application. Preference is given in this context to the transition metal salts selected from the group consisting of manganese and/or cobalt salts and/or complexes, particularly preferably cobalt ammine complexes, cobalt acetato complexes, cobalt carbonyl complexes, the chlorides of cobalt or of manganese and manganese sulfate. Similarly, zinc compounds may be used to prevent corrosion on the ware.

If corrosion inhibitors are used in multiphase shaped bodies, it is preferred to separate them from the bleaches. Accordingly, detergent or cleaner shaped bodies wherein one of the phases comprises bleaches while another one comprises corrosion inhibitors are preferred.

The separation of the bleaches from other ingredients may also be advantageous. Detergent or cleaner shaped bodies of the invention wherein one of the phases comprises bleaches while another comprises enzymes are likewise preferred. Suitable enzymes here include in particular those from the classes of the hydrolases such as the proteases, esterases, lipases or lipolytic enzymes, amylases, cellulases or other glycosyl hydrolases, and mixtures of said enzymes. In the washing, all of these hydrolases contribute to removing stains, such as proteinaceous, fatty or starchy marks and graying. Cellulases and other glycosyl hydrolases may, furthermore, contribute, by removing pilling and microfibrils, to the retention of color and to an increase in the softness of the textile. For bleaching and/or for inhibiting color transfer it is also possible to use oxidoreductases. Especially suitable enzymatic active substances are those obtained from bacterial strains or fungi such as *Bacillus subtilis, Bacillus licheniformis, Streptomyceus griseus, Coprinus cinereus* and *Humicola insolens*, and also from genetically modified variants thereof. Preference is given to the use of proteases of the subtilisin type, and especially to proteases obtained from *Bacillus lentus*. Of particular interest in this context are enzyme mixtures, examples being those of protease and amylase or protease and lipase or lipolytic enzymes, or protease and cellulase or of cellulase and lipase or lipolytic enzymes or of protease, amylase and lipase or lipolytic enzymes, or protease, lipase or lipolytic enzymes and cellulase, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases. The cellulases used are preferably cellobiohydrolases, endoglucanases and endoglucosidases, which are also called cellobiases, and mixtures thereof. Because different types of cellulase differ in their CMCase and Avicelase activities, specific mixtures of the cellulases may be used to establish the desired activities.

In cleaner tablets for machine dishwashing, naturally, different enzymes are used in order to take account of the different substrates treated and different types of soiling. Suitable enzymes here include in particular those from the classes of the hydrolases such as the proteases, esterases, lipases or lipolytic enzymes, amylases, glycosyl hydrolases, and mixtures of said enzymes. All of these hydrolases contribute to removing stains, such as proteinaceous, fatty or starchy marks. For bleaching, it is also possible to use oxidoreductases. Especially suitable enzymatic active substances are those obtained from bacterial strains or fungi such as *Bacillus subtilis, Bacillus licheniformis, Streptomyceus griseus, Coprinus cinereus* and *Humicola insolens*, and also from genetically modified variants thereof. Preference is given to the use of proteases of the subtilisin type, and especially to proteases obtained from *Bacillus lentus*. Of particular interest in this context are enzyme mixtures, examples being those of protease and amylase or protease and lipase or lipolytic enzymes, or of protease, amylase and lipase or lipolytic enzymes, or protease, lipase or lipolytic enzymes, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases.

The enzymes may be adsorbed on carrier substances or embedded in sheathing substances in order to protect them against premature decomposition. The proportion of the enzymes, enzyme mixtures or enzyme granules may be, for example, from about 0.1 to 5% by weight, preferably from 0.5 to about 4.5% by weight, based in each case on the phase in which they are used.

Further ingredients which may be a constituent of one or more phase(s) are, for example, cobuilders, dyes, optical brighteners, fragrances, soil release compounds, soil repellents, antioxidants, fluorescence agents, foam inhibitors, silicone fluids and/or paraffin oils, color transfer inhibitors, graying inhibitors, detergency boosters, etc. These substances are described below.

Organic builder substances which may be used are, for example, the polycarboxylic acids, usable in the form of their sodium salts, the term polycarboxylic acids meaning those carboxylic acids which carry more than one acid function. Examples of these are citric acid, adipic acid, succinic acid, glutaric acid, malic acid, tartaric acid, maleic acid, fumaric acid, sugar acids, amino carboxylic acids, nitrilotriacetic acid (NTA), provided such use is not objectionable on ecological grounds, and also mixtures thereof. Preferred salts are the salts of the polycarboxylic acids such as citric acid, adipic acid, succinic acid, glutaric acid, tartaric acid, sugar acids, and mixtures thereof.

The acids per se may also be used. In addition to their builder effect, the acids typically also possess the property of an acidifying component and thus also serve to establish a lower and milder pH of detergents or cleaners. In this context, mention may be made in particular of citric acid, succinic acid, glutaric acid, adipic acid, gluconic acid, and any desired mixtures thereof.

Also suitable as builders are polymeric polycarboxylates; these are, for example, the alkali metal salts of polyacrylic acid or of polymethacrylic acid, examples being those having a relative molecular mass of from 500 to 70 000 g/mol.

The molecular masses reported for polymeric polycarboxylates, for the purposes of this document, are weight-average molecular masses, $M_w$, of the respective acid form, determined basically by means of gel permeation chromatography (GPC) using a UV detector. The measurement was made against an external polyacrylic acid standard, which owing to its structural similarity to the polymers under investigation provides realistic molecular weight values. These figures differ markedly from the molecular weight values obtained using polystyrenesulfonic acids as the standard. The molecular masses measured against polystyrenesulfonic acids are generally much higher than the molecular masses reported in this document.

Suitable polymers are, in particular, polyacrylates, which preferably have a molecular mass of from 2 000 to 20 000 g/mol. Owing to their superior solubility, preference in this group may be given in turn to the short-chain polyacrylates, which have molar masses of from 2 000 to 10 000 g/mol, and particularly preferably from 3 000 to 5 000 g/mol.

Also suitable are copolymeric polycarboxylates, especially those of acrylic acid with methacrylic acid and of acrylic acid or methacrylic acid with maleic acid. Copolymers which have been found particularly suitable are those of acrylic acid with maleic acid which contain from 50 to 90% by weight acrylic acid and from 50 to 10% by weight maleic acid. Their relative molecular mass, based on free acids, is generally from 2 000 to 70 000 g/mol, preferably from 20 000 to 50 000 g/mol, and in particular from 30 000 to 40 000 g/mol.

The (co)polymeric polycarboxylates can be used either as powders or as aqueous solutions. The (co)polymeric polycarboxylate content of the compositions is preferably from 0.5 to 20% by weight, in particular from 3 to 10% by weight.

In order to improve the solubility in water, the polymers may also contain allylsulfonic acids, such as allyloxybenzenesulfonic acid and methallylsulfonic acid, for example, as monomers.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Further preferred copolymers are those whose monomers are preferably acrolein and acrylic acid/acrylic acid salts, and, respectively, acrolein and vinyl acetate.

Similarly, further preferred builder substances that may be mentioned include polymeric amino dicarboxylic acids, their salts or their precursor substances.

Particular preference is given to polyaspartic acids and their salts and derivatives, which have not only cobuilder properties but also a bleach-stabilizing action.

Further suitable builder substances are polyacetals, which may be obtained by reacting dialdehydes with polyol carboxylic acids having 5 to 7 carbon atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, examples being oligomers and polymers of carbohydrates, which may be obtained by partial hydrolysis of starches. The hydrolysis can be conducted by customary processes, for example, acid-catalyzed or enzyme-catalyzed processes. The hydrolysis products preferably have average molar masses in the range from 400 to 500 000 g/mol. Preference is given here to a polysaccharide having a dextrose equivalent (DE) in the range from 0.5 to 40, in particular from 2 to 30, DE being a common measure of the reducing effect of a polysaccharide compared with dextrose, which has a DE of 100. It is possible to use maltodextrins having a DE of between 3 and 20 and dried glucose syrups having a DE of between 20 and 37, and also so-called yellow dextrins and white dextrins having higher molar masses, in the range from 2 000 to 30 000 g/mol.

The oxidized derivatives of such dextrins are their products of reaction with oxidizing agents which are able to oxidize at least one alcohol function of the saccharide ring to the carboxylic acid function. A product oxidized on $C_6$ of the saccharide ring may be particularly advantageous.

Oxydisuccinates and other derivatives of disuccinates, preferably ethylenediaminedisuccinate, are further suitable cobuilders. Ethylenediamine-N,N'-disuccinate (EDDS) is used preferably in the form of its sodium or magnesium salts. Further preference in this context is given to glycerol disuccinates and glycerol trisuccinates as well. Suitable use amounts in formulations containing zeolite and/or silicate are from 3 to 15% by weight.

Examples of further useful organic cobuilders are acetylated hydroxycarboxylic acids and their salts, which may also be present in lactone form and which contain at least 4 carbon atoms, at least one hydroxyl group, and not more than two acid groups.

A further class of substance having cobuilder properties is represented by the phosphonates. These are, in particular, hydroxyalkanephosphonates and aminoalkanephosphonates. Among the hydroxyalkanephosphonates, 1-hydroxyethane-1,1-diphosphonate (HEDP) is of particular importance as a cobuilder. It is preferably used as the sodium salt, the disodium salt being neutral and the tetrasodium salt giving an alkaline (pH 9) reaction. Suitable aminoalkanephosphonates are preferably ethylenediaminetetra-methylenephosphonate (EDTMP), diethylenetriaminepenta-methylenephosphonate (DTPMP), and their higher homologs. They are preferably used in the form of the neutrally reacting sodium salts, e.g., as the hexasodium salt of EDTMP or as the hepta- and octasodium salt of DTPMP. As a builder in this case, preference is given to using HEDP from the class of the phosphonates. Furthermore, the aminoalkanephosphonates have a pronounced heavy-metal-binding capacity. Accordingly, and especially if the compositions also comprise bleach, it may be preferred to use aminoalkanephosphonates, especially DTPMP, or to use mixtures of said phosphonates.

Furthermore, all compounds capable of forming complexes with alkaline earth metal ions may be used as cobuilders.

In order to enhance the esthetic impression of the detergent and cleaner shaped bodies of the invention, they may in whole or in part be colored with appropriate dyes. Particular optical effects may be achieved if, in the case of shaped bodies made of two or more phases, the individual phases are differently colored. Preferred dyes, whose selection presents no difficulty whatsoever to the skilled worker, have a high level of storage stability and insensitivity toward the other ingredients of the compositions and to light and have no pronounced substantivity toward the substrates treated, such as textile fibers or parts of kitchen- or tableware, so as not to stain them.

Preference for use in the detergent shaped bodies of the invention is given to all colorants which can be oxidatively destroyed in the wash process, and to mixtures thereof with suitable blue dyes, known as bluing agents. It has proven advantageous to use colorants which are soluble in water or at room temperature in liquid organic substances. Examples of suitable colorants are anionic colorants, e.g., anionic nitroso dyes. One possible colorant is, for example, naphthol green (Colour Index (CI) Part 1: Acid Green 1; Part 2: 10020) which as a commercial product is obtainable, for example, as Basacid® Green 970 from BASF, Ludwigshafen, and also mixtures thereof with suitable blue dyes. Further suitable colorants include Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-O, CI Acid Blue 183), Pigment Blue 15 (CI 74160), Supranol® Blue GLW (CAS 12219-32-8, CI Acid Blue 221), Nylosan® Yellow N-7GL SGR (CAS 61814-57-1, CI Acid Yellow 218) and/or Sandolan® Blue (CI Acid Blue 182, CAS 12219-26-0).

In the context of the choice of colorant it must be ensured that the colorants do not have too great an affinity toward the textile surfaces, and especially toward synthetic fibers. At the same time, it should also be borne in mind in choosing appropriate colorants that colorants have different stabilities with respect to oxidation. The general rule is that water-insoluble colorants are more stable to oxidation than water-soluble colorants. Depending on the solubility and hence also on the oxidation sensitivity, the concentration of the colorant in the detergents and cleaners varies. With readily water-soluble colorants, e.g., the abovementioned Basacid® Green, or the likewise abovementioned Sandolan® Blue, colorant concentrations chosen are typically in the range from a few $10^{-2}$ to $10^{-3}$% by weight. In the case of the pigment dyes, which are particularly preferred for reason of their brilliance but are less readily soluble in water, examples being the abovementioned Pigmosol® dyes, the appropriate concentration of the colorant in detergents or cleaners, in contrast, is typically from a few $10^{-3}$ to $10^{-4}$% by weight.

The detergent and cleaner shaped bodies of the invention may comprise one or more optical brighteners. These substances, which are also called "whiteners", are used in modern detergents because even freshly washed and bleached white laundry has a slight yellow tinge. Optical brighteners are organic dyes which convert part of the invisible UV radiation of sunlight into longer-wave blue light. The emission of this blue light fills the "gap" in the light reflected by the textile, so that a textile treated with optical brightener appears whiter and brighter to the eye. Since the mechanism of action of brighteners necessitates their attachment to the fibers, a distinction is made in accordance with the fibers "to be dyed" between, for example, brighteners for cotton, nylon, or polyester fibers. The commercially customary brighteners suitable for incorporation into detergents belong primarily to five structural groups: the stilbene group, the diphenylstilbene group, the coumarin-quinoline group, the diphenylpyrazoline group, and the group involving combination of benzoxazole or benzimidazole with conjugated systems. Examples of suitable brighteners are salts of 4,4'-bis[(4-anilino-6-morpholino-s-triazin-2-yl)amino]stilbene-2,2'-disulfonic acid or compounds of similar structure which instead of the morphilino group carry a diethanolamino group, a methylamino group, an anilino group, or a 2-methoxyethylamino group. Furthermore, brighteners of the substituted diphenylstyryl type may be present, examples being the alkali metal salts of 4,4'-bis(2-sulfostyryl)biphenyl, 4,4'-bis(4-chloro-3-sulfostyryl)-biphenyl, or 4-(4-chlorostyryl)-4'-(2-sulfostyryl)-biphenyl. Mixtures of the abovementioned brighteners may also be used.

Fragrances are added to the compositions of the invention in order to improve the esthetic appeal of the products which are formed and to provide the consumer with not only the performance of the product but also a visually and sensorially "typical and unmistakable" product. As perfume oils and/or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8-18 carbon atoms, citral, citronellal, citronellyloxy-acetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol, and terpineol; the hydrocarbons include primarily the terpenes such as limonene and pinene. Preference, however, is given to the use of mixtures of different odorants, which together produce an appealing fragrance note. Such perfume oils may also contain natural odorant mixtures, as are obtainable from plant sources, examples being pine oil, citrus oil, jasmine oil, patchouli oil, rose oil or ylang-ylang oil. Likewise suitable are muscatel, clary sage oil, camomile oil, clove oil, balm oil, mint oil, cinnamon leaf oil, lime blossom oil, juniperberry oil, vetiver oil, olibanum oil, galbanum oil and labdanum oil, and also orange blossom oil, neroliol, orange peel oil, and sandalwood oil.

The fragrance content of the detergent and cleaner shaped bodies prepared in accordance with the invention is usually up to 2% by weight of the overall formulation. The fragrances may be incorporated directly into the compositions of the invention; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be additionally coated with further auxiliaries.

In addition, the detergent and cleaner shaped bodies may also comprise components which have a positive influence on the ease with which oil and grease are washed off from textiles (so-called soil repellents). This effect becomes particularly marked when a textile is soiled that has already been laundered previously a number of times with a detergent of the invention comprising this oil- and fat-dissolving component. The preferred oil- and fat-dissolving components include, for example, nonionic cellulose ethers such as methylcellulose and methylhydroxypropylcellulose having a methoxy group content of from 15 to 30% by weight and a hydroxypropyl group content of from 1 to 15% by weight, based in each case on the nonionic cellulose ether, and also the prior art polymers of phthalic acid and/or terephthalic acid, and/or derivatives thereof, especially polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

Foam inhibitors which may be used in the compositions produced in accordance with the invention are suitably, for example, soaps, paraffins or silicone oils, which may if desired have been applied to carrier materials.

Graying inhibitors have the function of keeping the dirt detached from the fiber in suspension in the liquor and so preventing the redeposition of the dirt. Suitable for this purpose are water-soluble colloids, usually organic in nature, examples being the water-soluble salts of polymeric carboxylic acids, glue, gelatin, salts of ethersulfonic acids of starch or of cellulose, or salts of acidic sulfuric esters of cellulose or of starch. Water-soluble polyamides containing acidic groups are also suitable for this purpose. Furthermore, soluble starch preparations and starch products other than those mentioned above may be used, examples being degraded starch, aldehyde starches, etc. Polyvinylpyrrolidone may also be used. Preference, however, is given to the use of cellulose ethers such as carboxymethylcellulose (Na salt), methylcellulose, hydroxyalkylcellulose, and mixed ethers such as methylhydroxyethylcellulose, methyl-hydroxypropylcellulose, methylcarboxymethylcellulose and mixtures thereof in amounts of from 0.1 to 5% by weight, based on the compositions.

Since fabrics, especially those of filament rayon, viscose rayon, cotton and blends thereof, may tend to crease, because the individual fibers are susceptible to bending, buckling, compressing and pinching transverse to the fiber direction, the compositions produced in accordance with the invention may comprise synthetic crease control agents. These include, for example, synthetic products based on fatty acids, fatty acid esters, fatty acid amides, fatty acid alkylol esters, fatty acid alkylolamides, or fatty alcohols, which are usually reacted with ethylene oxide, or else products based on lecithin or on modified phosphoric esters.

In order to combat microorganisms, the compositions produced in accordance with the invention may comprise antimicrobial active substances. In this context a distinction is made, depending on antimicrobial spectrum and mechanism of action, between bacteriostats and bactericides, fungiostats and fungicides, etc. Examples of important substances from these groups are benzalkonium chlorides, alkylarylsulfonates, halophenols, and phenylmercuric acetate, it also being possible to dispense with these compounds entirely.

In order to prevent unwanted changes to the compositions and/or the treated textiles as a result of oxygen exposure and other oxidative processes, the compositions may comprise antioxidants. This class of compound includes, for example, substituted phenols, hydroquinones, pyrocatechols and aromatic amines, and also organic sulfides, polysulfides, dithiocarbamates, phosphites, and phosphonates.

Increased wear comfort may result from the additional use of antistats which are additionally added to the compositions produced in accordance with the invention. Antistats increase the surface conductivity and thus enable better dissipation of charges that are formed. External antistats are generally substances having at least one hydrophilic molecule ligand, and provide a more or less hygroscopic film on the surfaces. These antistats, which are usually interface-active, may be subdivided into nitrogen-containing (amines, amides, quaternary ammonium compounds), phosphorus-containing (phosphoric esters), and sulfur-containing (alkylsulfonates, alkyl sulfates) antistats.

In order to improve the water absorption capacity, the rewettability of the treated textiles, and to facilitate ironing of the treated textiles, silicone derivatives, for example, may be used in the compositions produced in accordance with the invention. These derivatives additionally improve the rinse-out behavior of the compositions, by virtue of their foam inhibiting properties. Examples of preferred silicone derivatives are polydialkylsiloxanes or alkylaryl-siloxanes where the alkyl groups have one to five carbon atoms and are totally or partially fluorinated.

Preferred silicones are polydimethylsiloxanes, which may if desired have been derivatized and in that case are amino-functional or quaternized, or have Si—OH, Si—H and/or Si—Cl bonds. The viscosities of the preferred silicones at 25° C. are in the range between 100 and 100 000 centistokes, it being possible to use the silicones in amounts of between 0.2 and 5% by weight, based on the overall composition.

Finally, the compositions produced in accordance with the invention may also comprise UV absorbers, which attach to the treated textiles and improve the light stability of the fibers. Compounds which have these desired properties are, for example, the compounds which are active via radiationless deactivation, and derivatives of benzophenone having substituents in position(s) 2 and/or 4. Also suitable are substituted benzotriazoles, acrylates which are phenyl-substituted in position 3 (cinnamic acid derivatives), with or without cyano groups in position 2, salicylates, organic Ni complexes, and also natural substances such as umbelliferone and the endogenous urocanic acid.

With all of the abovementioned ingredients, advantageous properties may result from separating them from other ingredients and/or from formulating them together with certain other ingredients. In the case of multiphase shaped bodies, the individual phases may also differ in the amount they contain of the same ingredient, as a result of which advantages may be achieved.

The detergent and cleaner shaped bodies according to the invention dissolve completely in the washing or cleaning cycle, where, as mentioned above, it may have advantages if the different regions have different dissolution rates. Here, for example as a result of hardness and/or content of disintegration auxiliaries in individual tableted phases, the viscoelastic phase can go into solution at a time significantly prior to the tableted phase(s). As a result of the different dissolution rates, as well as the release of certain ingredients at certain times, the properties of the washing or cleaning liquor can also be changed in a targeted manner. Thus, for example, preference is given to detergent and cleaner shaped bodies in which the pH of a 1% strength by weight solution in water is in the range from 8 to 12, preferably from 9 to 11 and in particular from 9.5 to 10.

For esthetic reasons and because of better handlability, preference is given to shaped bodies according to the invention in which the viscoelastic phase is surrounded by two tableted phases. In particular, the layer structure is suitable here. In the simplest case, such a preferred shaped body according to the invention has the form of a three-layer tablet whose outer layers are tableted while the middle layer is the viscoelastic phase. The outer "covers" can of course also consist of multilayer tablets, and even the viscoelastic phase can be composed of two or more viscoelastic phases optionally of varying composition. Preference is given here to detergent or cleaner shaped bodies according to the invention which have two tableted phases which have the form of layers, where the viscoelastic phase is located as the third layer between the tableted layers.

The tabletability of the tableted phases and their hardness/solubility profile can be improved if their surfactant content is kept as low as possible. Preference is given here to those detergent or cleaner shaped bodies of tableted and viscoelastic portions in which the tableted phase(s), in each case based on their weight, comprise less than 15% by weight, preferably less than 7% by weight, particularly preferably less than 3% by weight and in particular no surfactant(s).

The configuration of the above-described three-layer tablet is particularly visually attractive when the viscoelastic layer constitutes 0.1 to 0.6 times, preferably 0.15 to 0.5 times and in particular 0.2 to 0.4 times, the total height of the tablets.

The premix can be composed of the widest variety of substances, as described above. Irrespective of the composition of the premixes to be compressed in process step a), physical parameters of the premixes can be chosen so that advantageous shaped body properties result.

To produce the tableted phase(s), particulate premixes are compressed in a so-called die between two punches to give a solid compact. This operation, which is referred to below in short as tableting, is divided into four sections: metering, compression, plastic deformation and ejection.

Firstly, the premix is introduced into the die, the fill level and thus the weight and the shape of the resulting shaped body being determined by the position of the lower punch and by the shape of the compression tool. Even in the case of high shaped body throughputs, constant metering is preferably achieved by volumetric metering of the premix. In the subsequent course of tableting, the upper punch contacts the premix and is lowered further in the direction of the lower punch. In the course of this compression, the particles of the premix are pressed closer to one another, with a continual reduction in the void volume within the filling between the punches. When the upper punch reaches a certain position (and thus when a certain pressure is acting on the premix), plastic deformation begins in which the particles coalesce and the shaped body forms. Depending on the physical properties of the premix, a portion of the premix particles is also crushed and at even higher pressures there is sintering of the premix. With an increasing compression rate, i.e. high throughputs, the phase of the elastic deformation becomes shorter and shorter, with the result that the shaped bodies which form may have larger or smaller voids. In the final step of tableting, the finished shaped body is ejected from the die by the lower punch and conveyed away by means of downstream transport means. At this point in time, it is only the weight of the shaped body which has been ultimately defined, since the compacts may still change their shape and size as a result of physical processes (elastic relaxation, crystallographic effects, cooling etc.).

The tableting is carried out in standard commercial tableting presses, which may in principle be equipped with single or double punches. In the latter case, pressure is built up not only using the upper punch, but the lower punch as well moves toward the upper punch during the compression operation, while the upper punch presses downward. For small production volumes it is preferred to use eccentric tableting presses in which the punch or punches is/are attached to an eccentric disk, which is in turn mounted on an axle having a defined speed of rotation. The movement of these compression punches is comparable with the way in which a customary four-stroke engine works. Compression can take place with one upper and one lower punch, or else a plurality of punches may be attached to one eccentric disk, the number of die bores being increased correspondingly. The throughputs of eccentric presses vary, depending on the model, from several hundred up to a maximum of 3000 tablets per hour.

In eccentric presses, the lower punch generally does not move during the compression operation. A consequence of this is that the resulting tablet has a hardness gradient, i.e. is harder in the regions which were closer to the upper punch than in the regions which were closer to the lower punch. For the purposes of the present invention, such tablets are preferably arranged such that the "softer" side is on the inside, i.e. is in contact with the viscoelastic phase. The "hard" side is then on the outside and effects high stability. In this way, it is possible, using compression forces which are reduced overall, to obtain stable and rapidly soluble tablets.

For larger throughputs, the presses chosen are rotary tableting presses in which a relatively large number of dies is arranged in a circle on a so-called die table. Depending on the model, the number of dies varies between 6 and 55, larger dies also being available commercially. Each die on the die table is allocated an upper punch and a lower punch, it being possible again for the compressive pressure to be built up actively by the upper punch or lower punch only, or else by both punches. The die table and the punches move around a common vertical axis, and during rotation the punches, by means of rail-like cam tracks, are brought into the positions for filling, compression, plastic deformation and ejection. At those sites where considerable raising or lowering of the punches is necessary (filling, compression, ejection), these cam tracks are assisted by additional low-pressure sections, low tension rails and discharge tracks. The die is filled by way of a rigid supply means, the so-called filling shoe, which is connected to a storage vessel for the premix. The compressive force on the premix can be adjusted individually for upper punch and lower punch by way of compression paths, the pressure being built up by the rolling movement of the punch shaft heads past displaceable pressure rolls.

In order to increase the throughput, rotary presses may also be provided with two filling shoes, where only one half-circle has to be travelled to produce one tablet. For the production of two-layer and multilayer shaped bodies, a plurality of filling shoes is arranged in series, and the gently pressed first layer is not ejected before further filling. By means of suitable process control, it is possible in this way to produce coated tablets and inlay tablets as well, having a construction like that of an onion skin, in the case of the inlay tablets the top face of the core or of the core layers not being covered and therefore remaining visible. Rotary tableting presses can also be equipped with single or multiple tools, so that, for example, an outer circle with 50 bores and an inner circle with 35 bores are used simultaneously for compression. The throughputs of modern rotary tableting presses amount to more than one million shaped bodies per hour.

The "covers" for the purposes of the present invention may of course likewise have a multiphase, in particular multilayer, structure. Thus, it is, for example, possible to use two-layer tablets as "cover", where the layer of the respective two-layer tablet which has contact with the viscoelastic phase can be chosen in terms of its composition and thickness also as a "barrier layer", which prevents penetration of ingredients from or into the viscoelastic phase.

The shaped bodies can be produced in predetermined three-dimensional shapes and predetermined size. Suitable three-dimensional shapes are virtually all practicable designs, i.e., for example, in the form of bars, rods or ingots, tubes, blocks and corresponding three-dimensional elements having planar side faces, and in particular cylindrical designs with a circular or oval cross section. The latter design covers dosage forms ranging from tablets through to compact cylinder lengths with a height to diameter ratio of more than 1.

The three-dimensional shape of another embodiment of the shaped bodies is adapted in its dimensions to the dispensing drawer of commercially available domestic washing machines or the dosing drawer of standard commercial dishwashing machines, so that the shaped bodies can be metered directly into the dispensing drawer where they dissolve during the rinsing-in process, or from where they are released during the cleaning operation. It is, however, of course also possible to use the detergent and cleaner shaped bodies via dosing aids without problems.

Following compression, the detergent and cleaner shaped bodies have high stability. The fracture strength of cylindrical shaped bodies can be ascertained by means of the parameter of diametral fracture stress. This can be determined by $$\sigma = \frac{2P}{\pi D t}$$

where σ represents the diametral fracture stress (DFS) in Pa, P is the force in N which leads to the pressure exerted on the shaped body, which pressure causes fracture of the shaped body, D is the diameter of the shaped body in meters, and t is the height of the shaped bodies.

EXAMPLES

To prepare viscoelastic phases according to the invention, the following raw materials were mixed together:

| | I1 | I2 | I3 |
|---|---|---|---|
| Alkylbenzenesulfonic acid (alicronic acid) | 76.63 | 67.90 | 58.20 |
| Nonionic surfactants | 0.00 | 0.00 | 10.00 |
| Cobuilders | 0.00 | 0.00 | 0.54 |
| NaOH | 10.50 | 15.00 | 12.20 |
| Salts/traces | 2.37 | 2.10 | 1.86 |
| Thickeners* | 0.00 | 0.00 | 5.00 |
| $H_2O$ | 10.50 | 15.00 | 12.20 |

Here, viscoelastic phases with the following composition were formed

| | I1 | I2 | I3 |
|---|---|---|---|
| Na ABS | 81.88 | 72.55 | 62.19 |
| Nonionic surfactants | 0.00 | 0.00 | 10.00 |
| Cobuilders | 0.00 | 0.00 | 0.54 |
| NaOH | 0.95 | 6.54 | 4.95 |
| Salts/traces | 2.37 | 2.10 | 1.86 |
| Thickeners* | 0.00 | 0.00 | 5.00 |
| $H_2O$ | 14.80 | 18.81 | 15.46 |

*tallow alcohol (Dehydol ® TA 30)

The storage modulus and the loss modulus of the viscoelastic phases according to the invention are evident from the table below (measurement using a UDS 2000 rheometer from Paar Physika in accordance with the plate-plate 25 mm measurement system, 2 mm gap, at 20° C.).

| | I1 | I2 | I3 |
|---|---|---|---|
| Storage modulus [Pa] | 82,000 | 64,000 | 240,000 |
| Loss modulus [Pa] | 15,000 | 15,000 | 80,000 |

The viscoelastic phases are stable, readily storable and readily soluble in cold and warm water.

Three-layer tablets according to the invention can be prepared by placing the abovementioned viscoelastic phases between two tablet "covers" by means of compression technology. Guide formulations for such tablet covers are for example (in each case based on the mass of the tableted phase):

| | |
|---|---|
| Phyllosilicates/waterglasses | 3-30% by wt., preferably 4 to 25% by wt. |
| Soda/potash | 0-30% by wt., preferably 10 to 25% by wt. |
| Bicarbonates | 0-30% by wt., preferably 3 to 20% by wt. |
| Na citrate/citric acid | 0-10% by wt., preferably 0 to 5% by wt. |
| Cobuilders | 0-10% by wt., preferably 0 to 5% by wt. |
| Bleaches | 0-50% by wt., preferably 5 to 40% by wt. |
| Bleach activators | 0-20% by wt., preferably 3 to 15% by wt. |
| Perfume oil | 0.1-2% by wt., preferably 0.2 to 1% by wt. |
| Optical brighteners | 0-2% by wt., preferably 0.1 to 1% by wt. |
| Foam inhibitors | 0-6% by wt., preferably 0.5 to 4% by wt. |
| Soil repellent | 0-5% by wt., preferably 0.2 to 3% by wt. |
| Enzymes | 0-5% by wt., preferably 1 to 4% by wt. |
| Disintegration auxiliaries | 0-10% by wt., preferably 3 to 8% by wt. |

The division of different ingredients between the two tableted phases may also be advantageous. If two "covers" with different compositions are prepared, then the following guide formulations are preferred:

| | Tableted phase 1 | | Tableted phase 2 | |
|---|---|---|---|---|
| | (min in %) | (max in %) | (min in %) | (max in %) |
| Phyllosilicates/waterglasses | 4.00 | 30.00 | 0.00 | 30.00 |
| Soda/potash | 0.00 | 25.00 | 10.00 | 30.00 |
| Cobuilders | 0.00 | 10.00 | 0.00 | 10.00 |
| Perfume oil | 0.10 | 1.00 | 0.10 | 1.00 |
| Percarbonates | 10.00 | 50.00 | 0.00 | 15.00 |
| TAED | 0.00 | 7.00 | 3.00 | 18.00 |
| Bicarbonates | 0.00 | 30.00 | 0.00 | 30.00 |
| Na citrate/citric acid | 0.00 | 10.00 | 0.00 | 10.00 |
| Sulfates anhydrous/div. fillers | 0.00 | 10.00 | 0.00 | 10.00 |
| Brighteners | 0.00 | 0.70 | 0.00 | 0.70 |
| Antifoam compound | 0.00 | 6.00 | 0.00 | 6.00 |
| Soil repellent | 0.00 | 3.00 | 0.00 | 3.00 |
| Enzymes | 0.00 | 5.00 | 0.00 | 5.00 |

-continued

| | Tableted phase 1 | | Tableted phase 2 | |
|---|---|---|---|---|
| | (min in %) | (max in %) | (min in %) | (max in %) |
| Powdering agents and colored powders | 0.00 | 3.00 | 0.00 | 3.00 |
| Solid-containing disintegrant | 3.00 | 10.00 | 3.00 | 10.00 |

Based on the overall tablet, the following amounts are preferred:

| | (min in %) | (max in %) |
|---|---|---|
| Phyllosilicates/ Waterglasses | 2.50 | 30.00 |
| Soda/potash | 5.00 | 27.50 |
| Cobuilders | 0.00 | 10.00 |
| Perfume oil | 0.10 | 1.00 |
| Percarbonates | 5.00 | 32.50 |
| TAED | 1.50 | 12.50 |
| Bicarbonates | 0.00 | 30.00 |
| Na citrate/citric acid | 0.00 | 10.00 |
| Sulfates anhydrous/div. fillers | 0.00 | 10.00 |
| Brighteners | 0.00 | 0.70 |
| Antifoam compound | 0.00 | 6.00 |
| Soil repellent | 0.00 | 1.50 |
| Enzymes | 0.00 | 5.00 |
| Powdering agents and colored powders | 0.00 | 3.00 |
| Solid-containing disintegrant | 3.00 | 10.00 |

The invention claimed is:

1. A detergent or cleaner shaped body in the form of a three-layer tablet comprising a viscoelastic phase, said phase comprising, based on its weight, 60 to 85% by weight of one or more alkylbenzenesulfonates, having a storage modulus of between 40,000 and 800,000 Pa and present in the form of a layer placed between two tableted phases, each in the form of a layer so that the three layers of the tablet exist and are visible over the entire circumference of the tablet.

2. The detergent or cleaner shaped body of claim 1, wherein the storage modulus of the viscoelastic phase is 50,000 to 750,000 Pa.

3. The detergent or cleaner shaped body of claim 2, wherein the storage modulus of the viscoelastic phase is 60,000 to 700,000 Pa.

4. The detergent or cleaner shaped body of claim 3, wherein the storage modulus of the viscoelastic phase is 70,000 to 650,000 Pa.

5. The detergent or cleaner shaped body of claim 4, wherein the storage modulus of the viscoelastic phase is 80,000 to 600,000 Pa.

6. The detergent or cleaner shaped body of claim 1, wherein the viscoelastic phase has a loss modulus having a value of no more than half the value of the storage modulus.

7. The detergent or cleaner shaped body of claim 6, wherein the viscoelastic phase has a loss modulus having a value of no more than one quarter the value of the storage modulus.

8. The detergent or shaped body of claim 1, wherein the viscoelastic phase has a phase shift in the range of 0° to 30°.

9. The detergent or cleaner shaped body of claim 1, wherein the viscoelastic phase has a phase shift in the range of 0° to 20°.

10. The detergent or cleaner shaped body of claim 1, wherein the viscoelastic phase has a phase shift in the range of 0°≦17°.

11. The detergent or cleaner shaped body of claim 1, wherein the viscoelastic phase comprises, based on its weight, 60 to 95% of one or more surfactants.

12. The detergent or cleaner shaped body of claim 1, wherein the viscoelastic phase comprises, based on its weight, 60 to 82.5% by weight of one or more alkylbenzenesulfonates.

13. The detergent or cleaner shaped body of claim 12, wherein the viscoelastic phase comprises, based on its weight, 60 to 80% by weight, one or more alkylbenzenesulfonates.

14. The detergent or cleaner shaped body of claim 1, wherein the viscoelastic phase comprises, based on its weight, 0 to 20% by weight of nonionic surfactant(s).

15. The detergent or cleaner shaped body of claim 1, wherein at least one of the tableted phases based on its weight, comprises 10 to 80% by weight of one or more builders.

16. The detergent or cleaner shaped body of claim 1, wherein at least one of the tableted phases comprises 20 to 75% by weight of one or more builders.

17. The detergent or cleaner shaped body of claim 1, wherein at least one of the tableted phases comprises 30 to 70% by weight of one or more builders.

18. The detergent or cleaner shaped body of claim 1, wherein at least one of the tableted phases has two layers.

19. The detergent or cleaner shaped body of claim 15, wherein the at least one tableted phase, based on its weight, comprises less than 15% by weight of surfactants.

20. The detergent or cleaner shaped body of claim 19, wherein the at least one tableted phase, based on its weight, comprises less than 7% by weight of surfactants.

21. The detergent or cleaner shaped body of claim 20, wherein the at least one tableted phase, based on its weight, comprises less than 3% by weight of surfactants.

22. The detergent or cleaner shaped body of claim 21, wherein the at least one tableted phase comprises no surfactants.

23. A detergent or cleaner shaped body in the form of a three-layer tablet comprising a viscoelastic phase, said phase comprising, based on its weight, 60 to 85% by weight of one or more alkylbenzenesulfonates, having a storage modulus of between 40,000 and 800,000 Pa and present in the form of a layer placed between two tableted phases, each in the form of a layer so that the three layers of the tablet exist and are visible over the entire circumference of the tablet wherein the viscoelastic layer constitutes 0.1 to 0.6 times the total height of the remaining layers.

24. The detergent or cleaner shaped body of claim 23, wherein the viscoelastic layer constitutes 0.15 to 0.5 times the total height of the remaining layers.

25. The detergent or cleaner shaped body of claim 24, wherein the viscoelastic layer constitutes 0.2 to 0.4 times the total height of the remaining layers.

* * * * *